US006691376B1

(12) United States Patent
Chen

(10) Patent No.: US 6,691,376 B1
(45) Date of Patent: Feb. 17, 2004

(54) FIRMLY SECURED PAPER CLIP

(76) Inventor: Hung-Wei Chen, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 10/223,742

(22) Filed: Aug. 20, 2002

(51) Int. Cl.[7] ..... A44B 21/00; A44C 3/00; A47B 19/00; B42F 1/02

(52) U.S. Cl. ..... 24/67 R; 24/67.1; 24/67 AR; 24/551; 24/555; 24/563; 40/1.6; 40/10

(58) Field of Search ..... 24/67 R, 67.1, 24/67 AR, 67 CF, 551, 552, 553, 554, 555, 545

(56) References Cited

U.S. PATENT DOCUMENTS 500,833 A * 7/1893 Wolfard ..... 24/67 R
857,908 A * 6/1907 Schorno ..... 24/67.1
1,153,094 A * 9/1915 McGinty ..... 24/67 R
2,566,837 A * 9/1951 Huelsmeyer ..... 24/67 R
3,466,774 A * 9/1969 Borresen ..... 40/10
3,612,461 A * 10/1971 Brown ..... 248/317
4,403,366 A * 9/1983 Lucke ..... 24/306
4,563,796 A * 1/1986 Kettlestrings ..... 24/563
5,357,653 A * 10/1994 van Ardenne ..... 24/555
5,881,434 A * 3/1999 Rigney ..... 24/563
6,006,455 A * 12/1999 Miller ..... 40/1.6

* cited by examiner

*Primary Examiner*—Victor Sakran

(57) ABSTRACT

A firmly secured paper clip comprises a foldable paper clip and a retainer. The paper clip is capable of being folded as three paper plates. The first paper plate is the longest one, and the third paper plate is the shortest one. The first paper plate is connected to the second paper plate and the second paper plate is connected to the third paper plate. In assembly, the second paper plate is folded and then is adhered on the first paper plate. Then the third paper plate is folded from the second paper plate and is located between the first paper plate and second paper plate. The retainer serves to fix the first paper plate and second paper plate to form the whole paper clip. Thereby, when a notepaper is inserted into a clamping opening between the first paper plate and third paper plate, it is firmly secured therein.

12 Claims, 17 Drawing Sheets

FIG. 11~1

FIRMLY SECURED PAPER CLIP

BACKGROUND OF THE INVENTION

The prior art paper clips may be notepaper paper clips, sticky tape, etc. The clip 90 is a plastic casing (referring to FIGS. 25 and 26). A front end of the body has a U shape opening 91. A rubber roller 92 or a smaller steel ball (not shown) is placed in the opening. When the notepaper 60*a* is inserted into the opening 91, it is pressed by the roller 92 or the small steel ball. This is because when the roller 92 or the small steel ball falls down due to the gravitational force, the notepaper 60*a* is pressed by the roller or the small steel ball so as not to fall out. However, the prior art has the following disadvantages:

1. Paper can not be inserted continuously. When the paper clip has clamped with one notepaper 60*a*, the insertion of the next notepaper 60*b* will cause the roller 92 or the small steel ball to move upwards or to separate from their positions so that the notepaper 60 falls down.
2. Not two much papers can be clamped. When the weight of the notepapers clamped is over the weight of the roller or the steel ball, they will fall down.
3. The prior art paper clips are made of plastics and the steel ball or rollers are made of different materials. They are difficult in detachment. Thereby, as the prior art is deserted, environmental pollution problem will be induced.
4. The volume is smaller, but a large volume after packed for transfer is large. This is inconvenient in storage, transfer and exhibition.

SUMMARY OF THE INVENTION

Accordingly, the primary object of the present invention is to provide a firmly secured paper clip comprising a foldable paper clip and a retainer. The paper clip is capable of being folded as three paper plates. The first paper plate is the longest one, and the third paper plate is the shortest one. The first paper plate is connected to the second paper plate and the second paper plate is connected to the third paper plate. In assembly, the first paper plate is used as a body, and the second paper plate is folded and then is adhered on the first paper plate. Then the third paper plate is folded from the second paper plate and is located between the first paper plate and second paper plate. The retainer serves to fix the first paper plate and second paper plate so as to form the whole paper clip. Thereby, when a notepaper is inserted into a clamping opening between the first paper plate and third paper plate, it is firmly secured therein.

The various objects and advantages of the present invention will be more readily understood from the following detailed description when read in conjunction with the appended drawing.

BRIEF DESCRIPTION OF THE DRAWINGS

FIG. 11-1 is an assembled schematic view of the adhesive element of FIG. 11.

DETAILED DESCRIPTION OF THE PREFERRED EMBODIMENTS

First Embodiment

Figure 1:
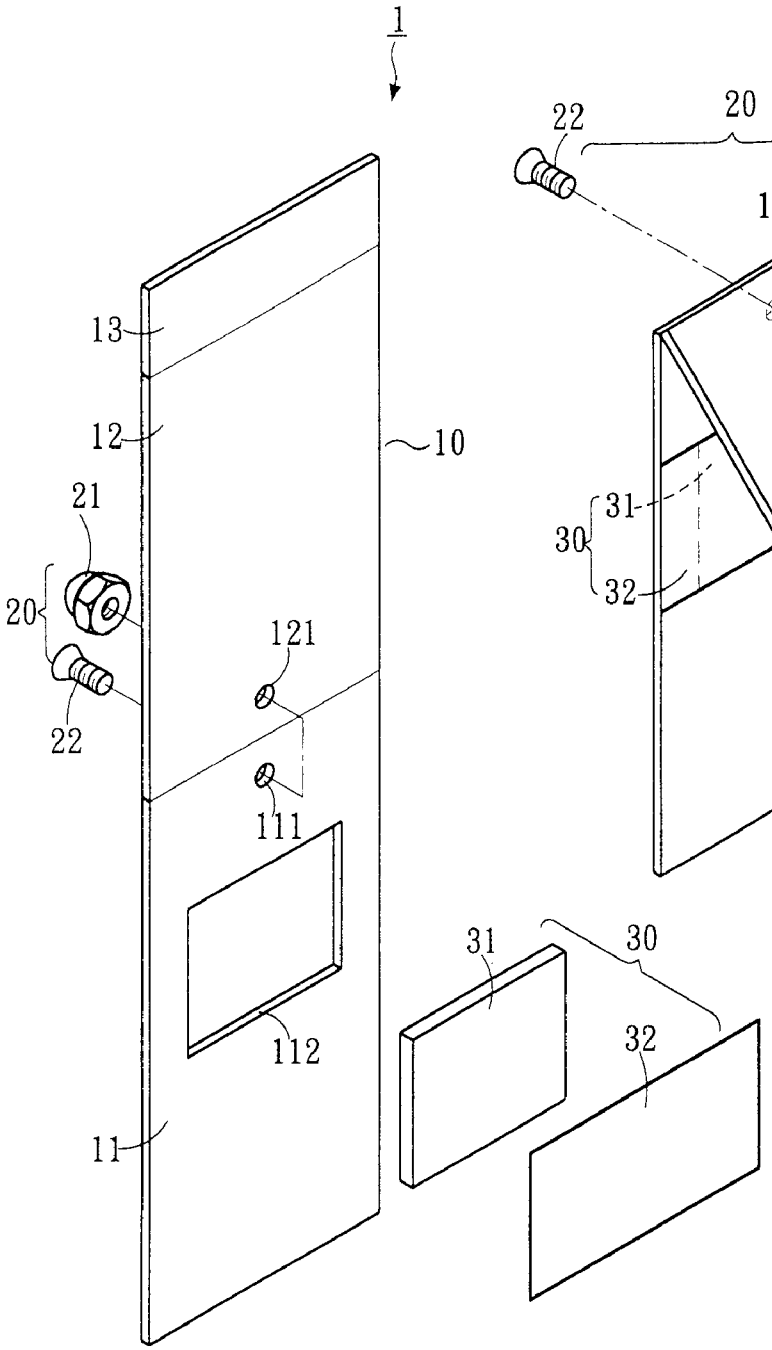
FIG. 1 is an exploded perspective view of the first embodiment of the firmly secured paper clip of the present invention.
Figure 2:
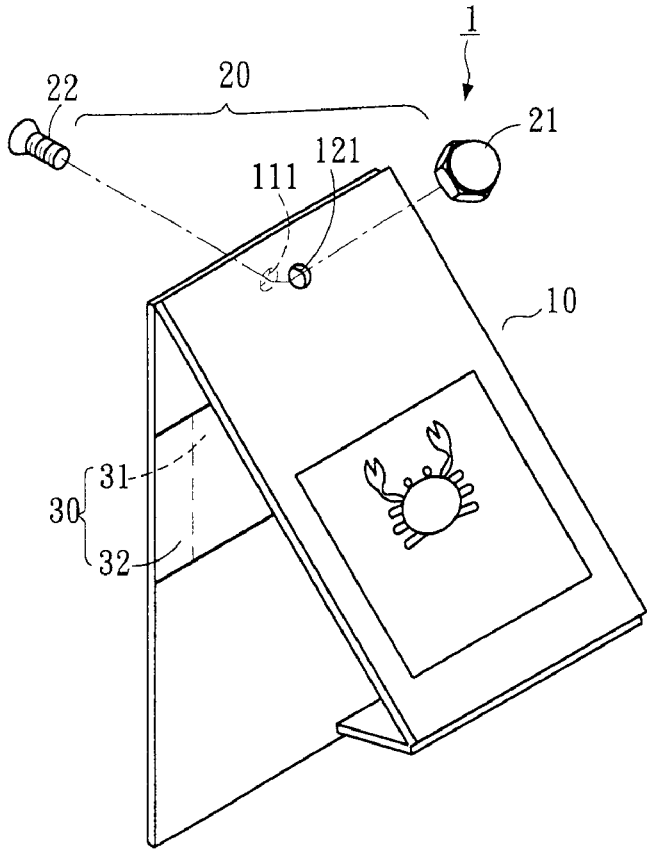
FIG. 2 is an assembled schematic view of the firmly secured paper clip in FIG. 1.

Referring to FIGS. 1 and 2, the exploded perspective view and schematic view of the paper clip of the present invention are illustrated. It is illustrated that the paper clip 1 is formed by a multiple folded long paper clip 10 and a retainer 20. The long paper clip 10 can be folded into at least three pieces of paper plates which are first paper plate 11, second paper plate 12 and third paper plate 13. The first paper plate 11 is the longest one, the second paper plate 12 has a middle length and the third paper plate 13 is shortest. One end of the first paper plate 111 is connected to the second paper plate 12 and another end of the second paper plate 12 is connected to the third paper plate 13.

Besides, the near the folding edge of the first paper plate 11 and second paper plate 12 are installed with a pair of symmetric small holes 111 and 121. The retainer 20 (such as nut 21 and screw 22) can pass therethrough for retaining the first paper plate 11 and second paper plate 12 tightly. Moreover, the retainer 20 of the present invention includes male and female buckles, long nails, sticky blanket, tapes, clamping tools, elastic strips, etc.

Moreover, the back side of the first paper plate 11 is formed with an adhesive element 30, such as magnetic blocks 31, double face tapes, sticky blankets, sticky tapes, etc. When the magnetic blocks 31 is used as the adhesive element, the magnetic blocks 31 is stuck to the back side of the first paper plate 11, or a sticky paper 32 having a larger area is adhered to the magnetic blocks 31. Then the sticky paper 32 is further stuck to the first paper plate 11. Then the magnetic blocks 31 is embedded into a paper plate frame 112 for being retained therein.

Figure 3A:
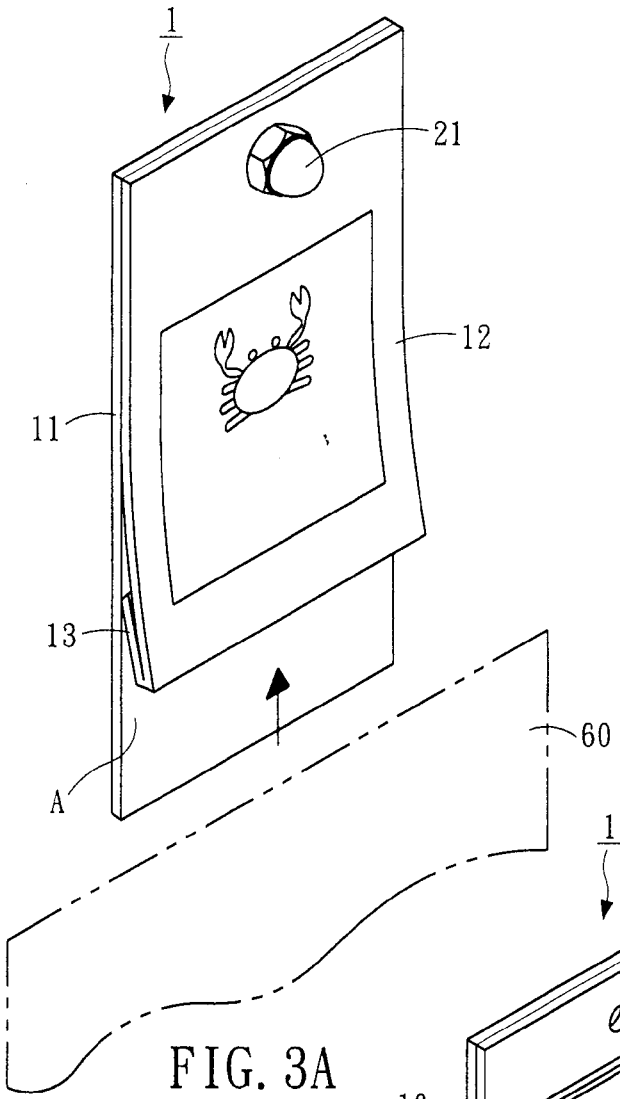
FIG. 3A is an assembled perspective view of the firmly secured paper clip of FIG. 1.

With reference to FIG. 3A, an assembled perspective view of the first embodiment according to embodiment is illustrated. It is illustrated that the second paper plate 12 is folded upon the first paper plate 11, and the third paper plate 13 is folded from the second paper plate 12 and then adheres to be between the first paper plate 11 and second paper plate 12 so as to form a clamping opening A for clamping objects. A gap is formed between the first paper plate 11 and third paper plate 13. Thereby, the tighter the retainer 20, the stronger the clamping effect.

Figure 3B:
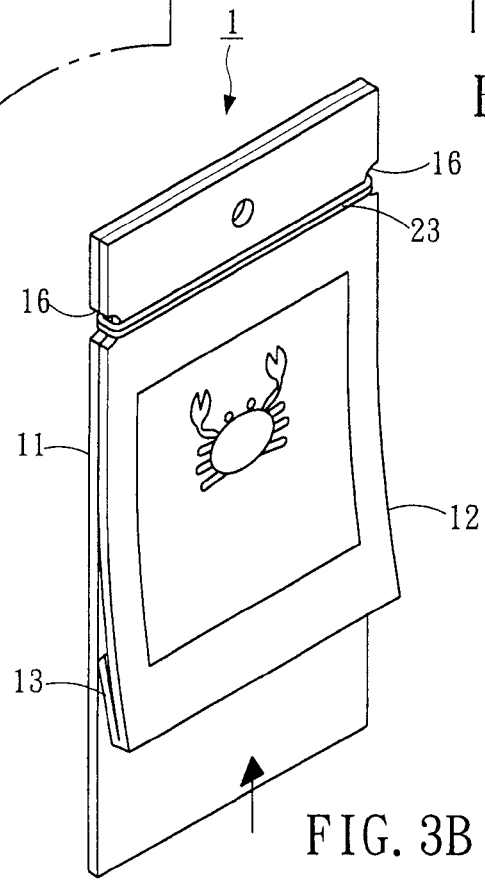
FIG. 3B is another assembled perspective view of the firmly secured paper clip of FIG. 1.

Referring to FIG. 3B, an assembled perspective view of the first embodiment of the present invention is illustrated. The difference from FIG. 3A is that the upper two sides of the first paper plate 11 and second paper plate 12 are formed with notches 16 for fixing an elastic strip 23. Thereby, the paper clip 1 of the present invention is formed and furthermore, the lower clamping opening has a larger clamping force.

Figure 4:
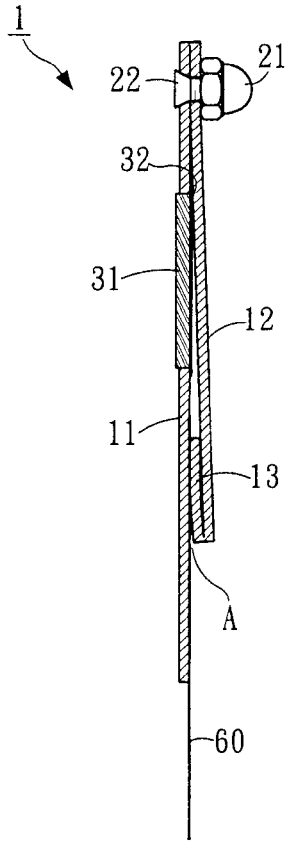
FIG. 4 is a whole cross sectional view of the firmly secured paper clip of FIG. 1.

With reference to FIG. 4, a cross sectional view of the first embodiment according to the present invention is illustrated. It is illustrated that the paper clip 1 is adhered to one surface of a metal object (for example, a metal cabinet, a file cabinet, a refrigerator, a metal door, etc.) by the magnetic blocks 31, while a clamping opening A is formed between the first paper plate 11 and third paper plate 13. After a notepaper 60 is inserted into the opening A, it is tightly clamped thereof the two paper plates without falling out.

Figure 5:
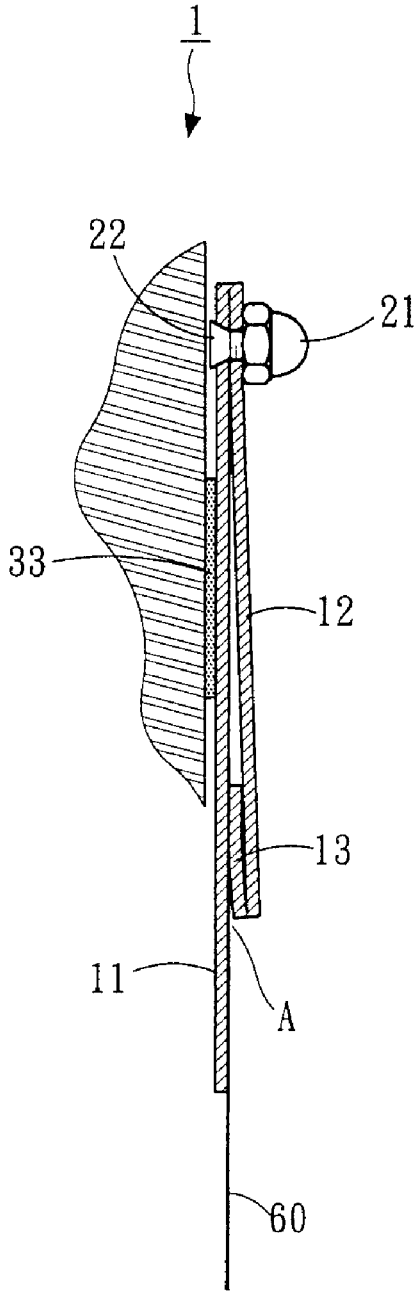
FIG. 5 is a cross sectional view showing another adhering way of the firmly secured paper clip in the present invention.
Figure 6:
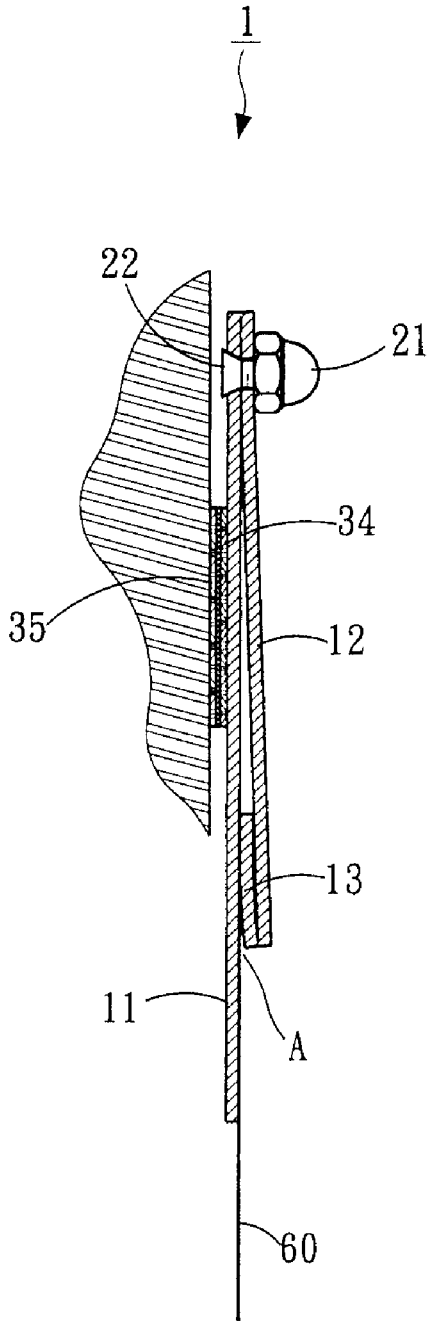
FIG. 6 is a cross sectional view showing another adhering way of the firmly secured paper clip in the present invention.

Referring to FIGS. 5 and 6, two different adhering elements used in the first embodiment are illustrated. In FIG. 5, the back side of the first paper plate 11 is adhered with a double face tape 33. By the double face tape 33, the paper clip 1 can be fixed to one surface of an object. With reference to FIG. 6, a back side of the first paper plate 11 is adhered with a sticky blanket 34. The sticky blanket 34 can be stuck to another sticky blanket 35 which is fixed to one surface of an object.

Second Embodiment

Figure 7:
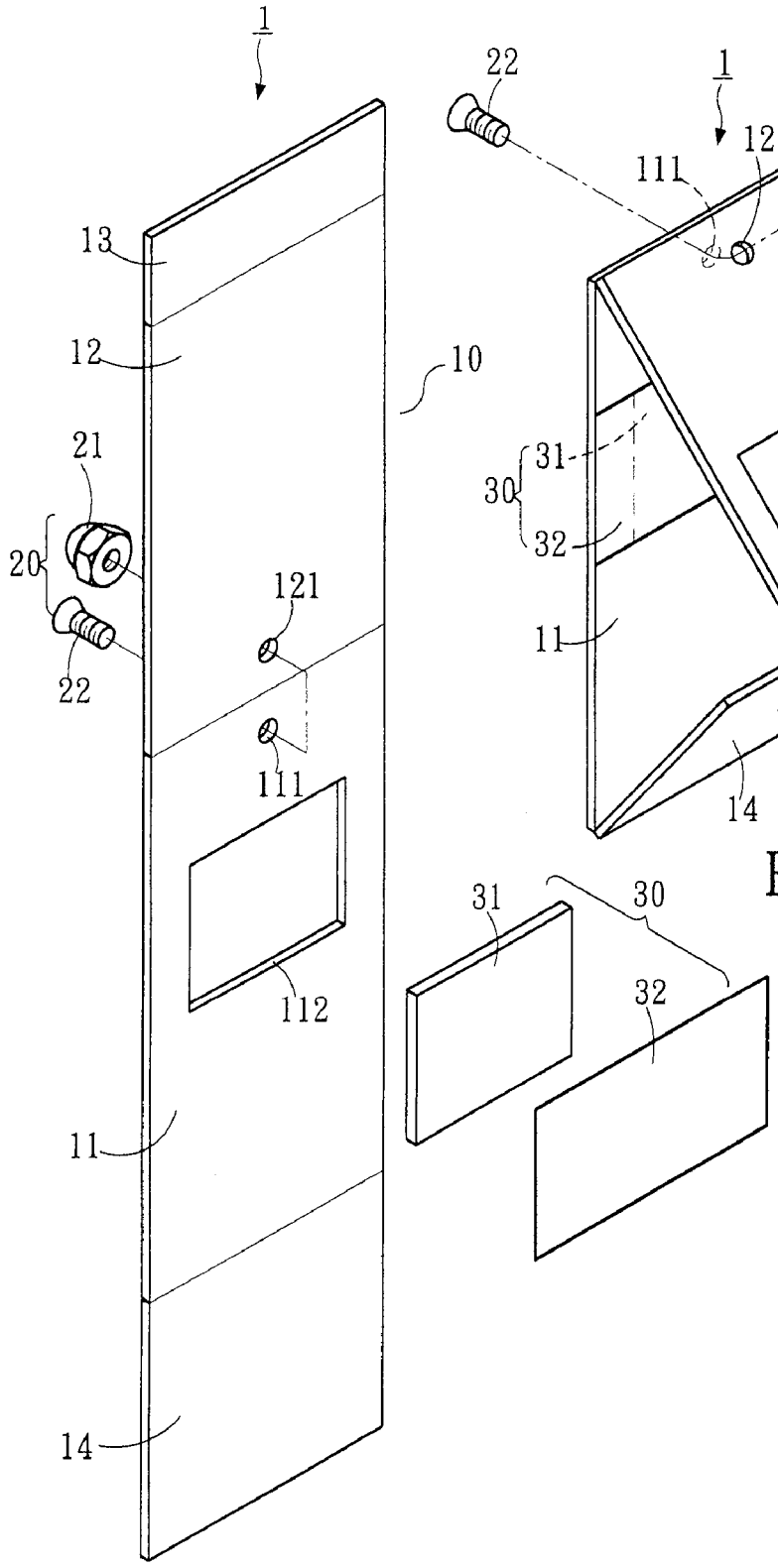
FIG. 7 is an exploded perspective view of the firmly secured paper clip in the second embodiment of the present invention.
Figure 8:
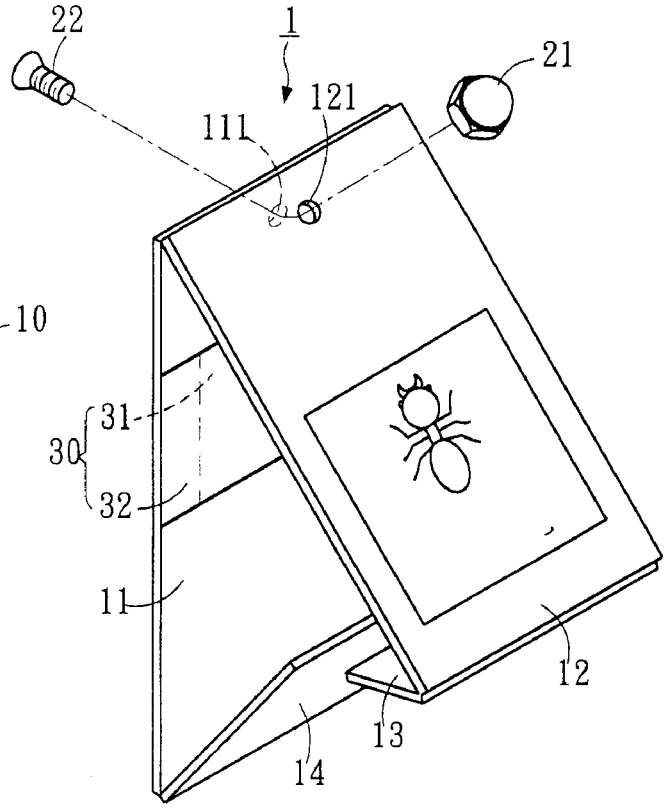
FIG. 8 is an assembled schematic view of the firmly secured paper clip in FIG. 7.
Figure 9:
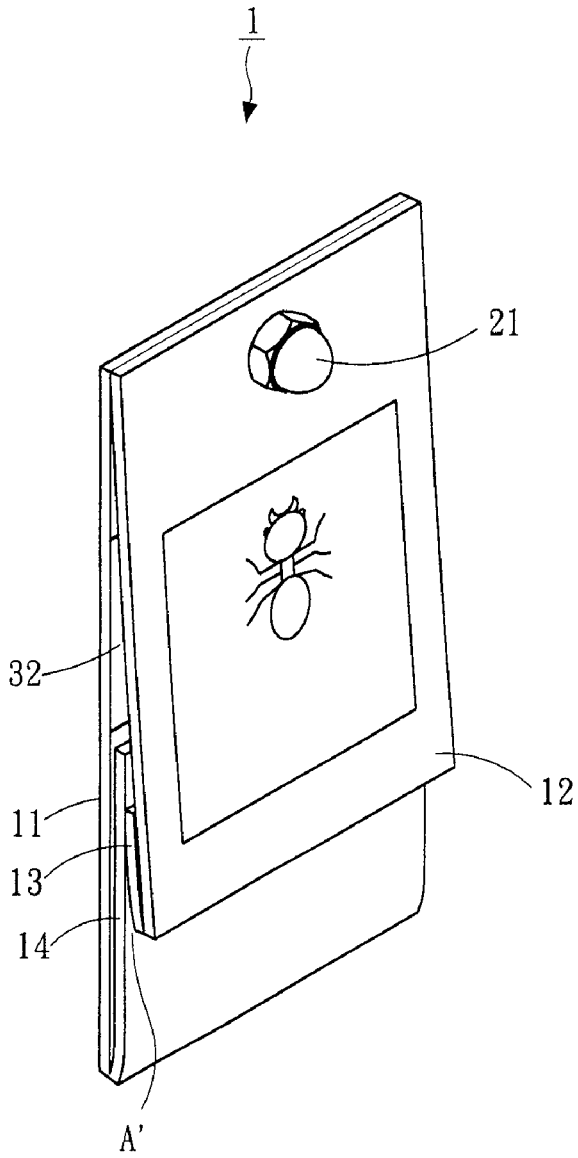
FIG. 9 is an assembled perspective view of the firmly secured paper clip of FIG. 7.
Figure 10:
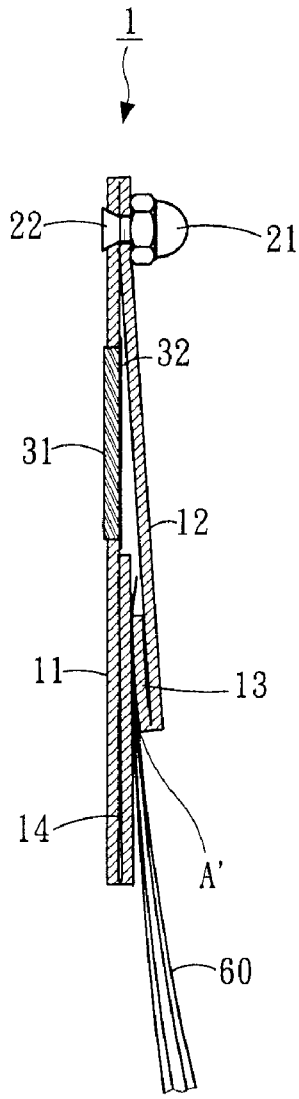
FIG. 10 is a whole cross sectional view of the firmly secured paper clip of FIG. 7.

Referring to FIGS. 7 and 8, the exploded perspective view and schematic view of the second embodiment according to embodiment are illustrated. In this second embodiment, the difference from the first embodiment is that another end of the first paper plate 11 is further extended with a fourth paper plate 14. After the fourth paper plate 14 is folded, it is clamped between the first paper plate 11 and third paper plate 13 (referring to FIGS. 9 and 10) so that a clamping opening A' is formed between the third paper plate 13 and fourth paper plate 14. The clamping force of this clamping opening A' is larger than the clamping force A of the first embodiment. The reason is that two paper plates are located at the upper end of the paper clip 1 and the lower end thereof have four paper plates (while in the first embodiment, only three paper plates are formed). The difference between the upper end and the lower end is the gap. The larger the gap, the tighter the fixing force between the second paper plate 12 and third paper plate 13 by the retainer 20, and vice versa.

Third Embodiment

Figure 11:
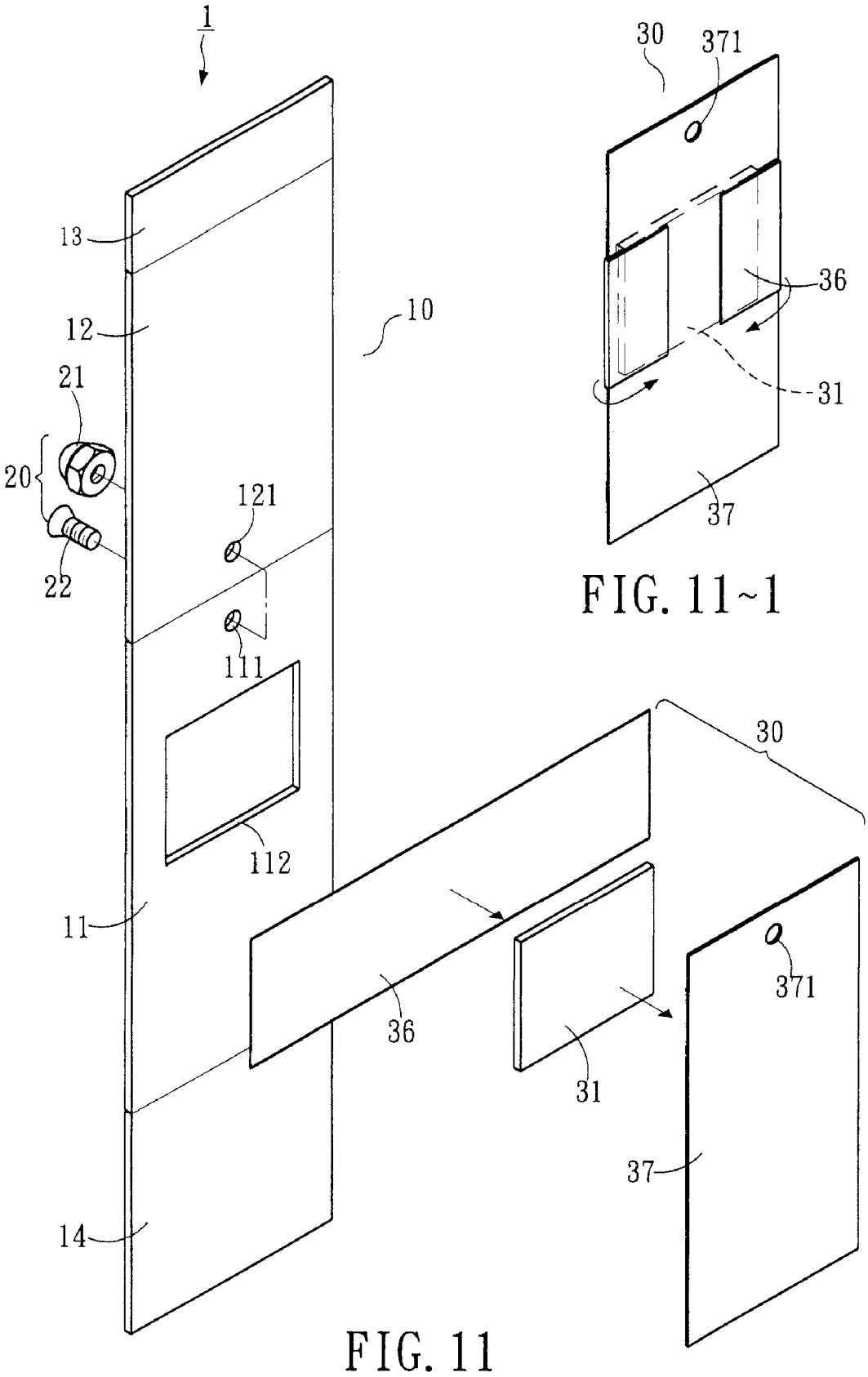
FIG. 11 is an exploded perspective view of the firmly secured paper clip in the third embodiment of the present invention.
Figure 12:
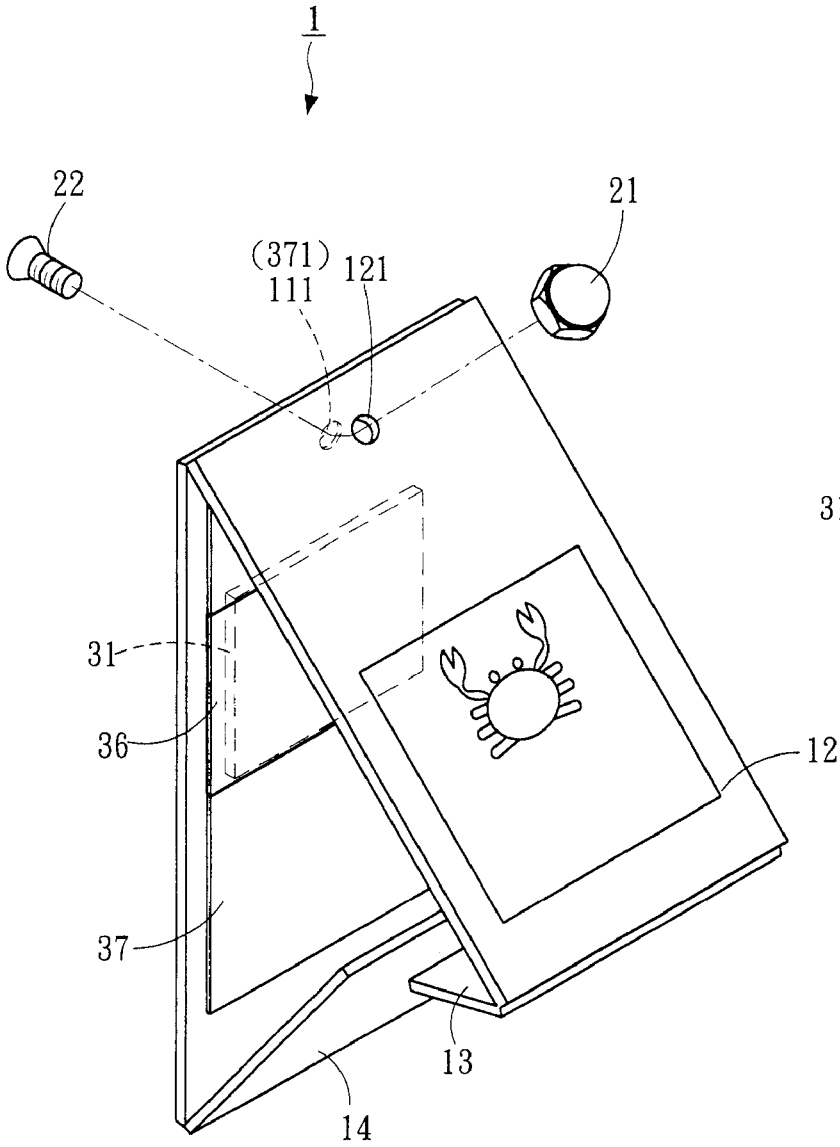
FIG. 12 is an assembled schematic view of the firmly secured paper clip in FIG. 11.
Figure 13:
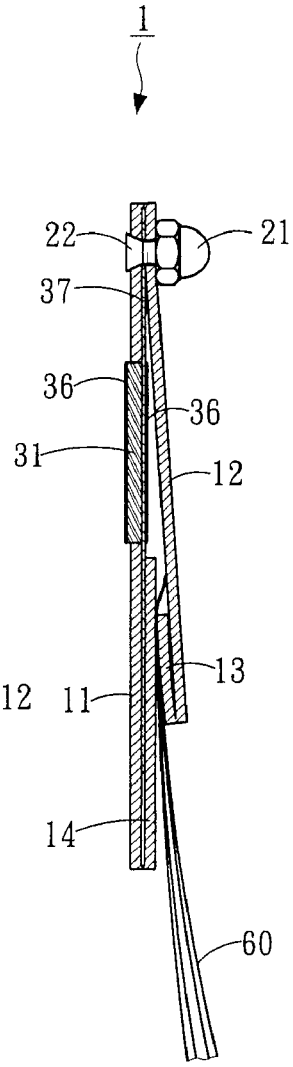
FIG. 13 is an whole cross sectional view of the firmly secured paper clip of FIG. 11.

FIG 11 shows an exploded perspective view of the third embodiment according to embodiment is illustrated. The difference of this embodiment from the second one is that the magnetic blocks 31 in the adhesive element 30 is formed by a thin sticky piece 36 adhered to a base piece 37 the (referring to FIGS. 11 and 11-1). Then the base piece 37 is stuck to the first paper plate 11. Then the magnetic blocks 31 is embedded into a frame groove 112 (referring to FIG. 12). After the small hole 371 of the base piece 37 is matched to the small holes 111 and 121. They are fixed by the retainer 20 to be formed as a complete paper clip 1. The advantage of this embodiment is that the paper clip 1 is adhered to the surface of one object. When the paper clip 1 is desired to be taken down from the object, a separating force will be formed, which is sufficient to cause the magnetic blocks 31 to separate from the frame groove 112. However, by the shielding effect of the base piece 37, the magnetic blocks 31 can not separate from the frame groove 112. Since the magnetic blocks 31 is fixed to the base piece 37 by the thin sticky piece, and the base piece 37 is shielded by the first paper plate 11, the magnetic blocks 31 can be separated therefrom. Thereby, the present embodiment has a preferred fixing effect than the previous one. Referring to FIG. 13, it is illustrated that a strong clamping opening A' is formed between the third paper plate 13 and fourth paper plate 14 at the lower side of the paper clip 1. This clamping opening A' is sufficient to firmly secure to the notepaper 60 in position without falling out.

The best advantage of this embodiment is that when the clamping openings A, A' of the paper clip 1 are clamped into the notepaper 60, if the user is necessary to further insert the notepaper 60 into the clamping opening, the former one inserted will not fall out. Thereby, notepapers can be inserted into the clamping openings continuously, but the prior art paper clip has no such a function. In the prior art, the user must hold the inserted notepapers by one hand, and inserts the following notepaper by another hand. Thereby, two hands are necessary in inserting notepapers. Furthermore, in the present invention, if it is desired to draw the notepapers out, it is only necessary to pull down the notepaper one by one, while other notepapers not being drawn out are still in position.

Fourth Embodiment

Figure 14:
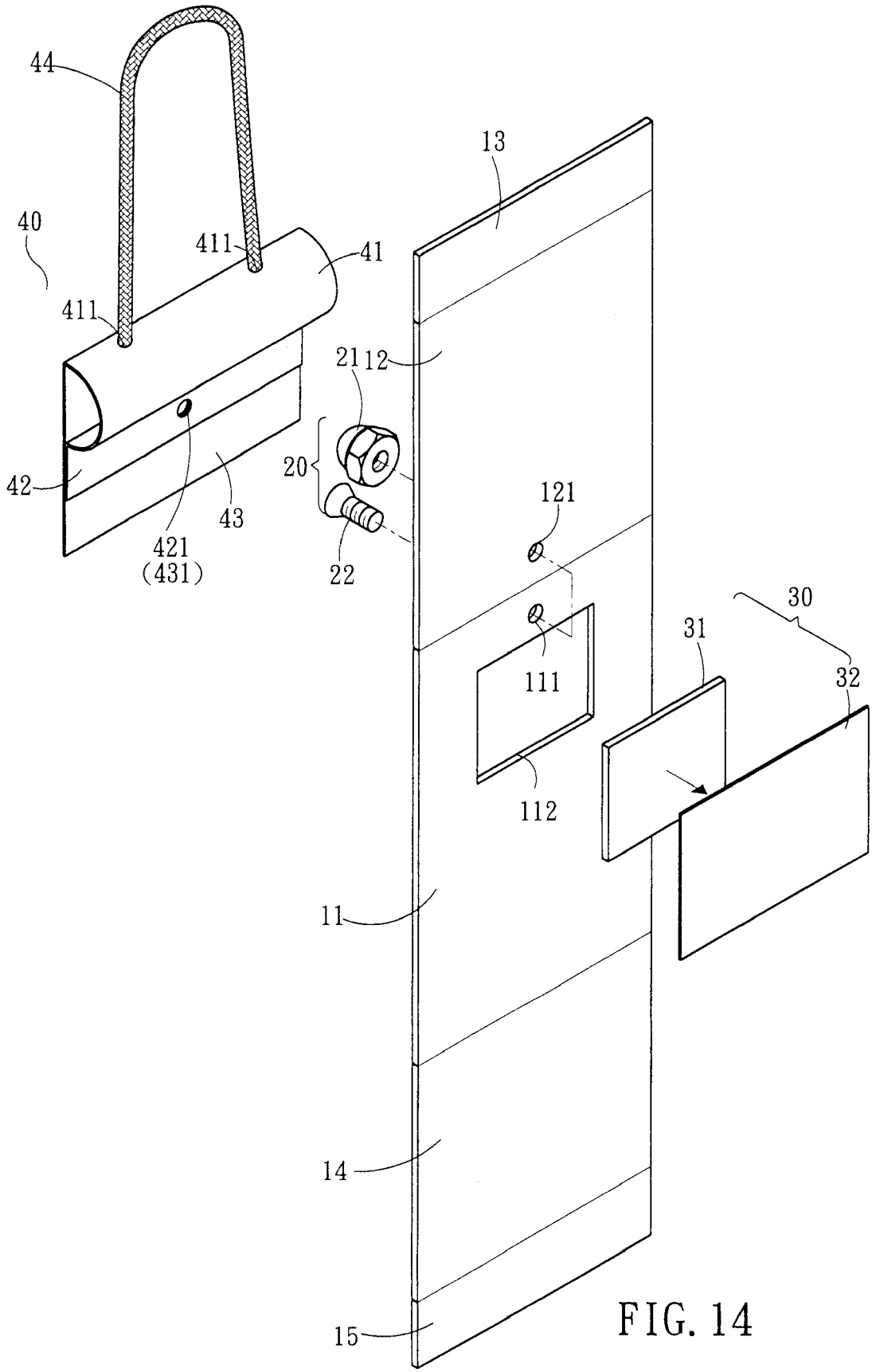
FIG. 14 is an exploded perspective view of the firmly secured paper clip in the fourth embodiment of the present invention.
Figure 15:
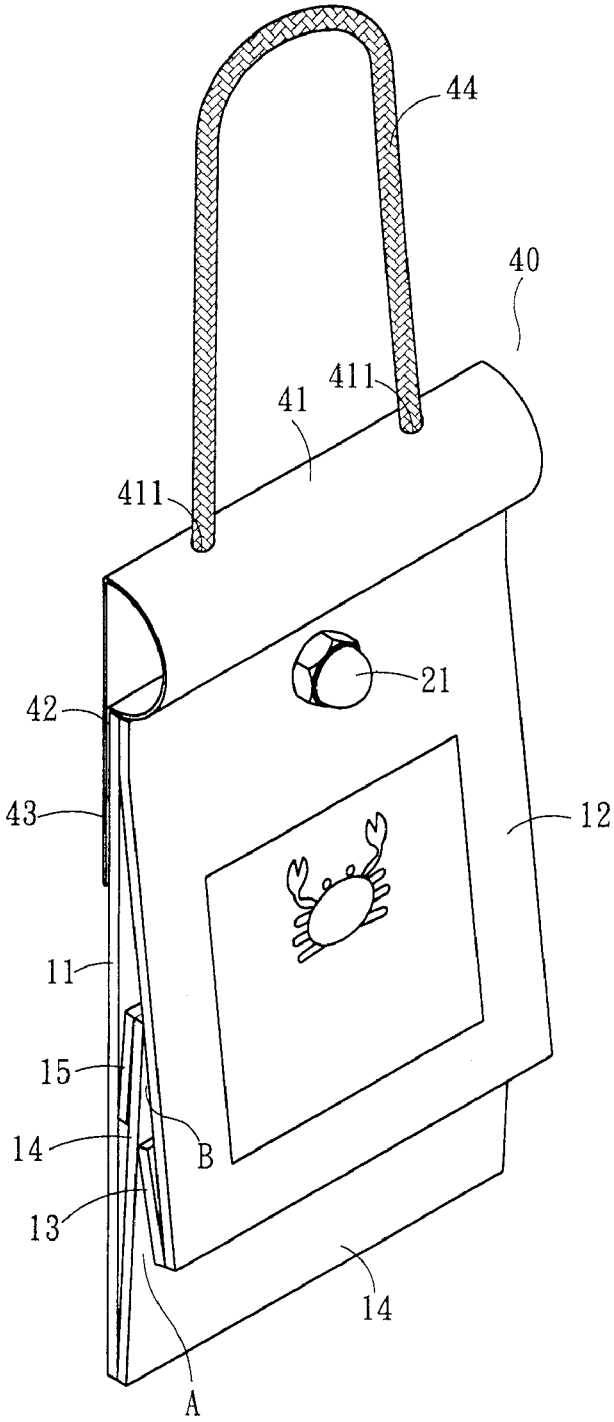
FIG. 15 is an assembled perspective view of the firmly secured paper clip in FIG. 14.

Referring to FIG. 14, the exploded perspective view of the fourth embodiment according to the present invention is illustrated. The difference of this embodiment from the previous one is that the another end of the fourth paper plate 14 is extended with a fifth paper plate 15. In FIG. 15, it is shown that the fifth paper plate 15 is folded between the first paper plate 11 and fourth paper plate 14, and the fourth paper plate 14 is between the third paper plate 13 and fifth paper plate 15. When the paper clip is fixed by the retainer 20, a first clamping opening A is formed between the third paper plate 13 and fourth paper plate 14 (referring to FIG. 16) and a second clamping opening B is formed between the second paper plate 12 and fourth paper plate 14. In forming the first clamping opening A, the third paper plate 13 gives a pressure upon the fourth paper plate 14. The fourth paper plate 14 is supported by the fifth paper plate 15 and then is pressed by the second paper plate 12. When notepaper 60 is inserted into the two clamping openings A and B, it is firmly secured therein and has a preferred effect than the previous embodiments.

Figure 16:
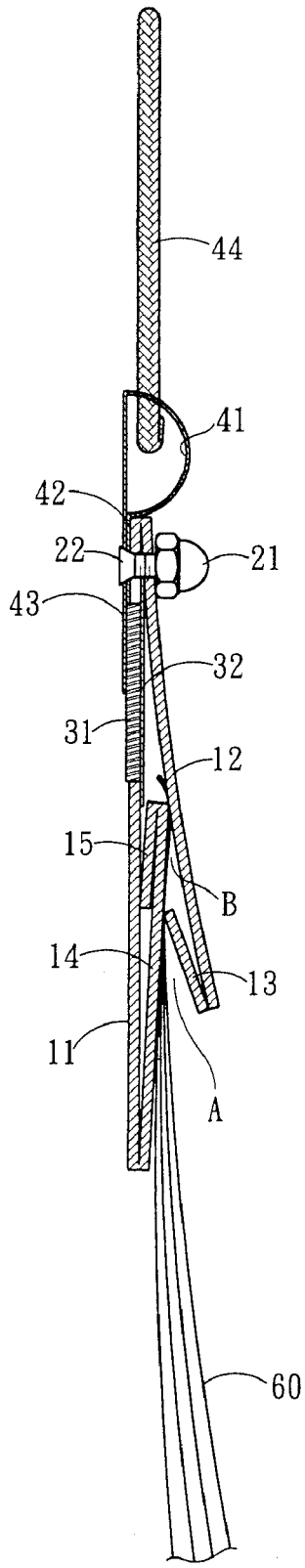
FIG. 16 is an whole cross sectional view of the firmly secured paper clip in FIG. 14.
Figure 17:
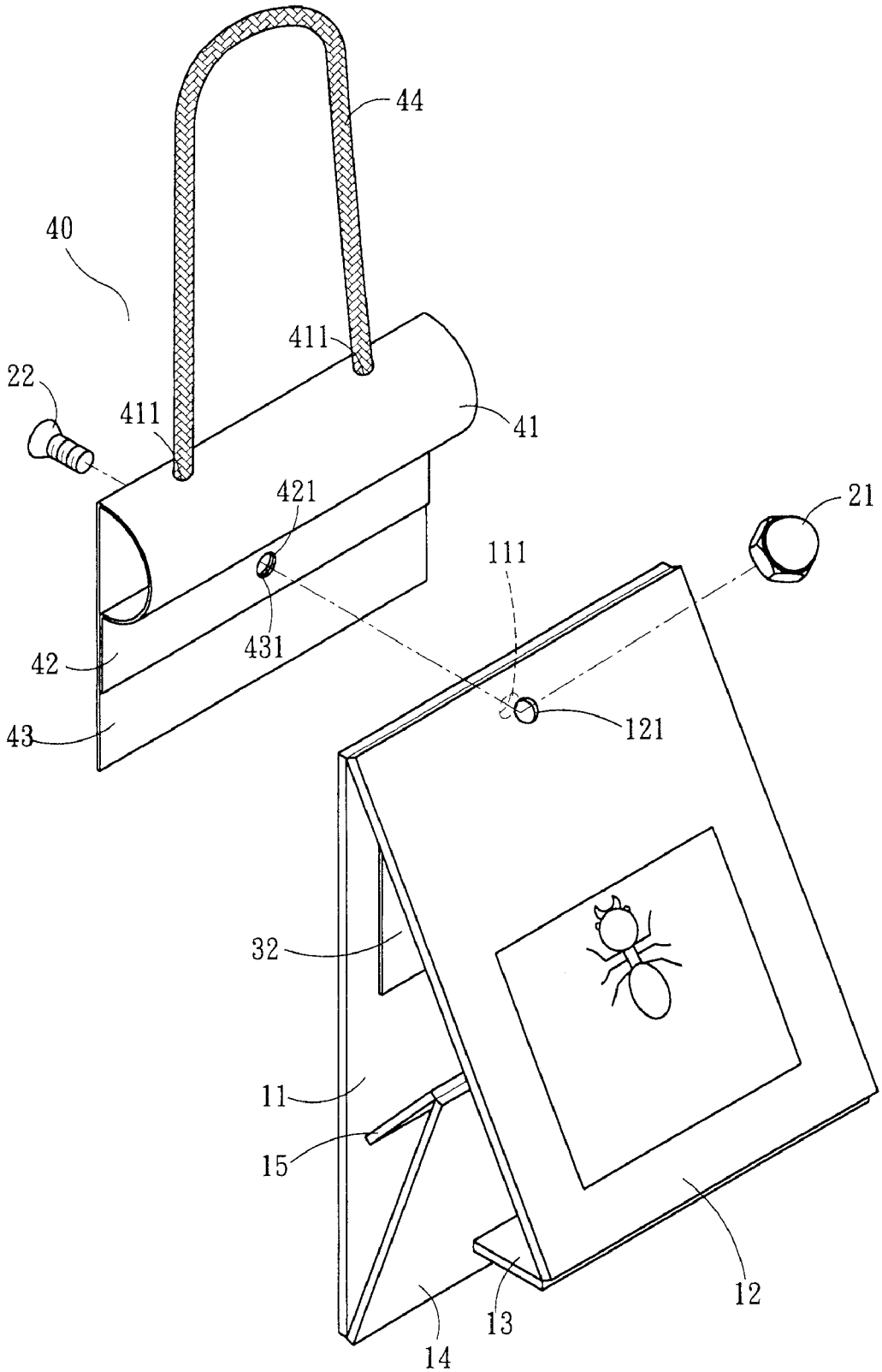
FIG. 17 is an exploded perspective view of the firmly secured paper clip and back plate of the present invention.
Figure 18:
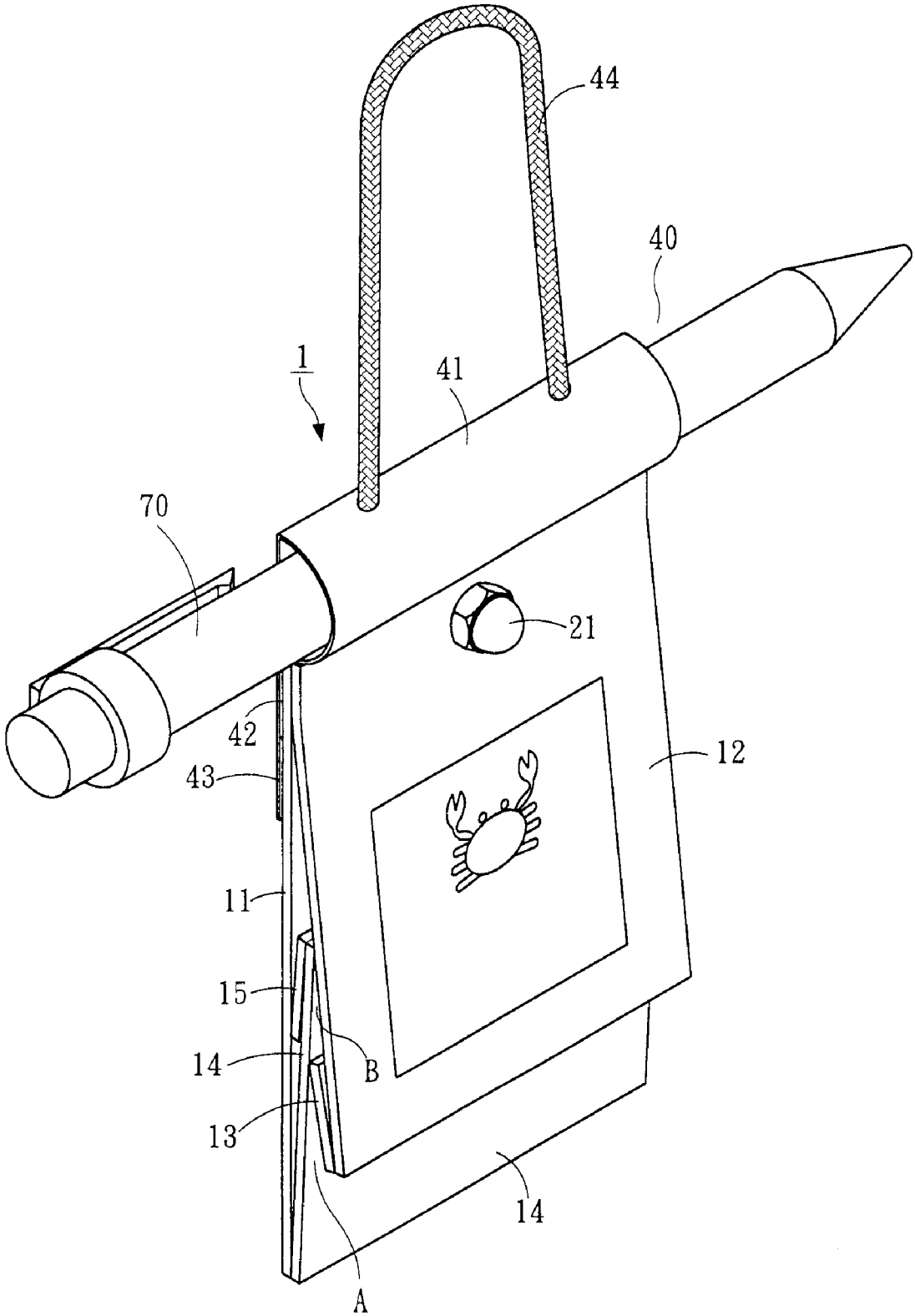
FIG. 18 is an assembled perspective view of the firmly secured paper clip and back plate of FIG. 17.

Besides, in FIGS. 14 to 16, a back plate 40 is illustrated. The upper end of the back plate 40 is a paper winding 41. The lower end thereof has two paper plates 42 and 43 extending from the paper winding 41 integrally. Preferably, the two paper plates 42, and 43 have matched small holes 421 and 431. The small holes 421, 431 are matched to the small holes 111, 121 of the paper plate. Then the retainer 20 serves to fix the paper winding (for example, the nut 21 and screw 22). Then, it is combined with the paper clip 1. The paper winding 41 can be inserted and positioned by a pen 70 (referring to FIG. 18). The use of the through hole 411 cause a strip 44 to be able to pass through the hole for suspending the paper clip to a protrusion (for example, a nail, stud, etc.).

Fifth Embodiment

Figure 19:
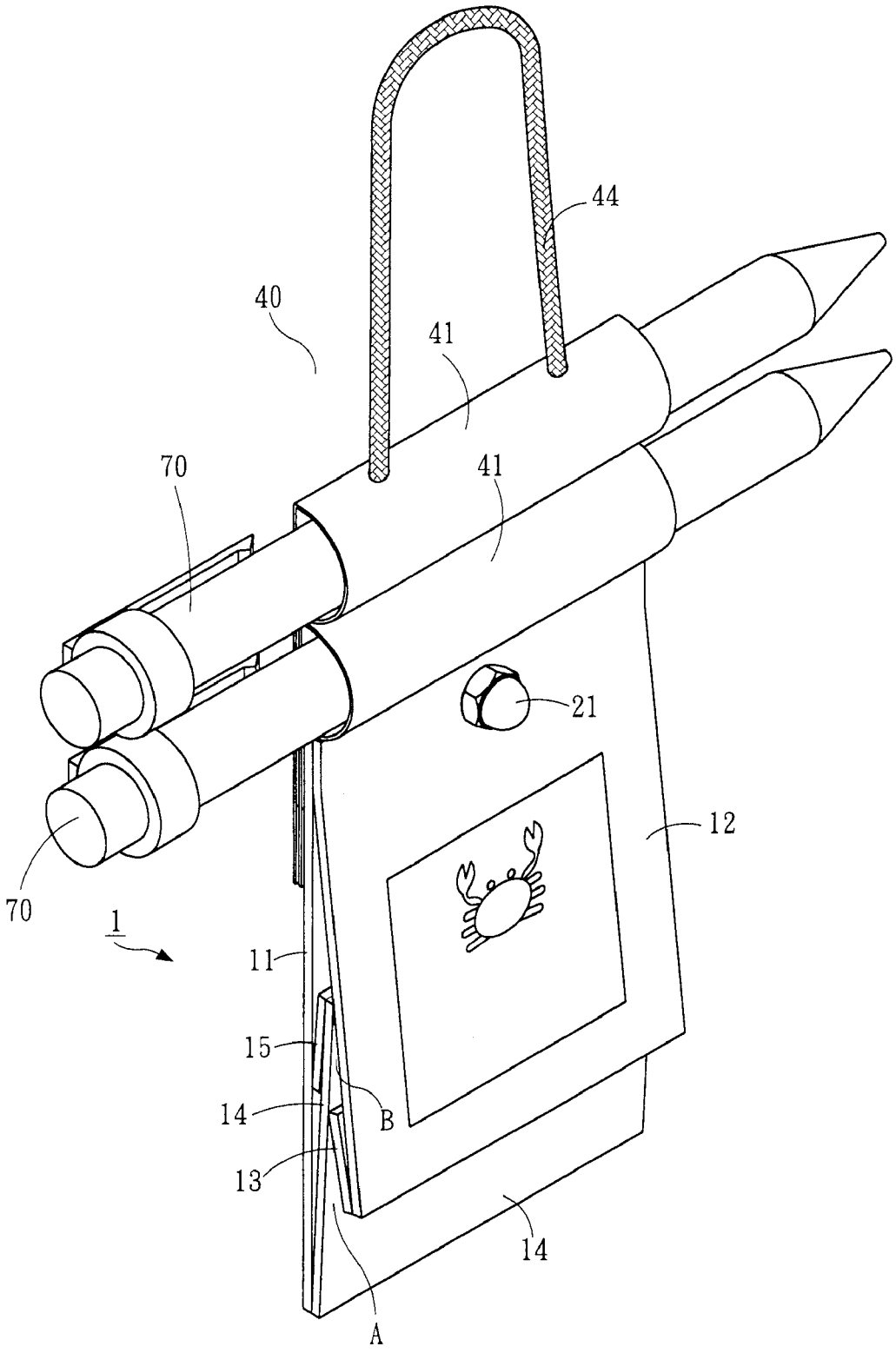
FIG. 19 is a perspective view of the firmly secured paper clip and back plate in the fifth embodiment in the present invention.

Next, a plurality of back plates 40 can be connected in the present invention. For example, in FIG. 19, two back plates 40 are fixed by a retainer 20 at the back side of the paper clip 1. The paper windings 41 of the two back plates are inserted by respective pens 70.

Sixth Embodiment

Figure 20:
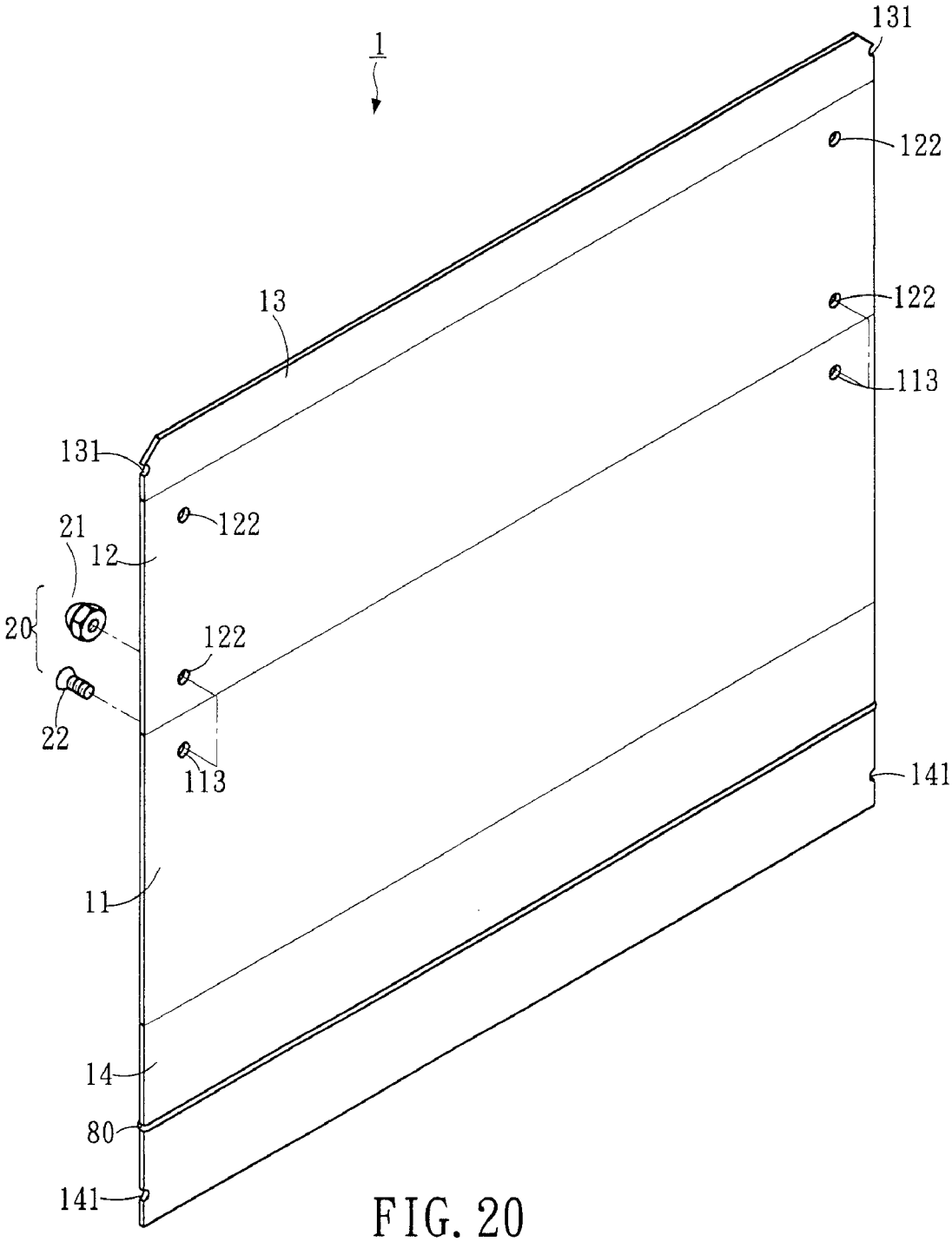
FIG. 20 is an expanding view of the firmly secured paper clip and back plate in the sixth embodiment of the present invention.
Figure 21:
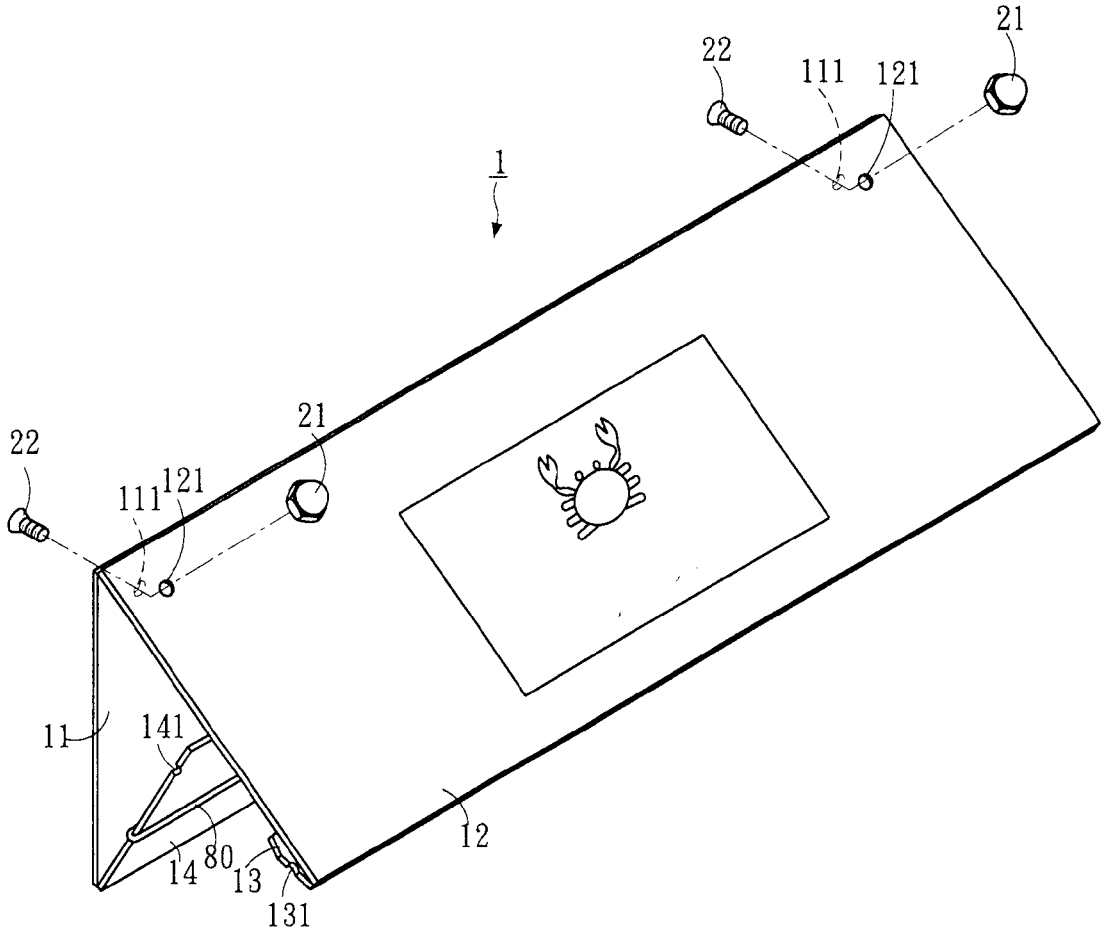
FIG. 21 is an assembled schematic view of the firmly secured paper clip in FIG. 20.
Figure 22:
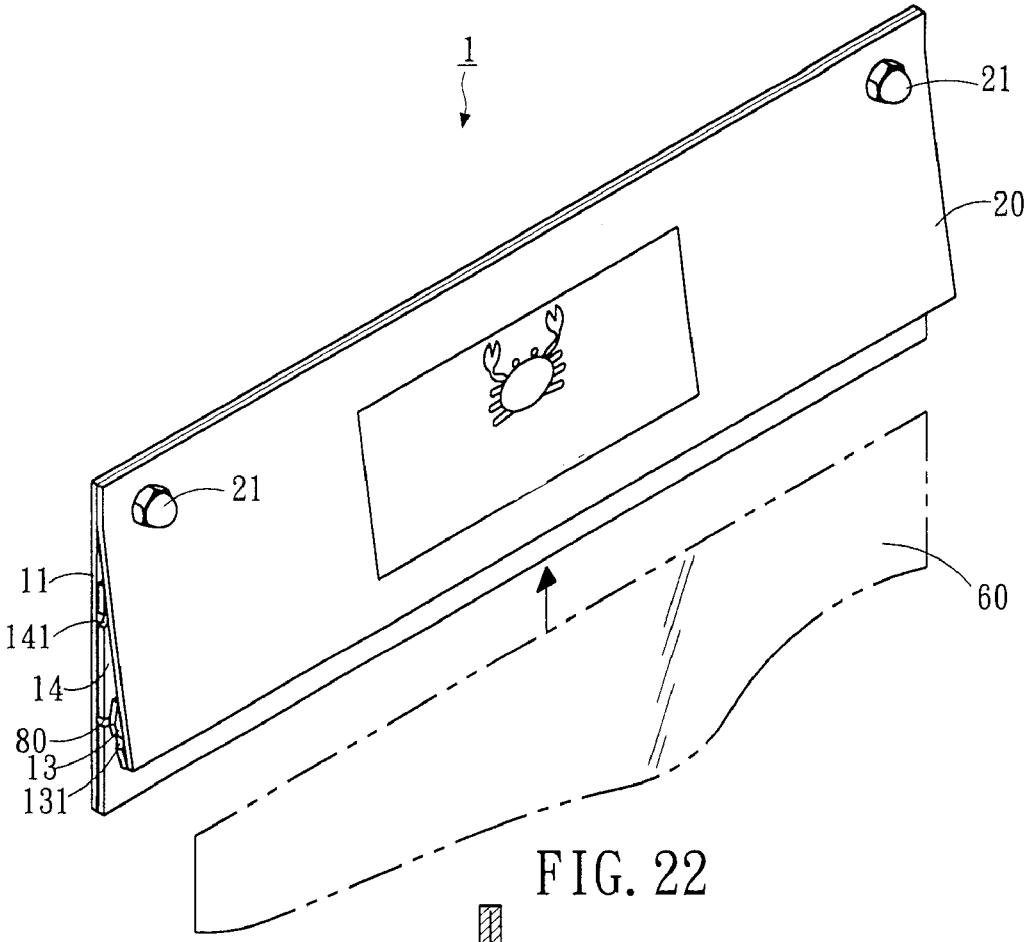
FIG. 22 is an assembled perspective view is an assembled perspective view of the firmly secured paper clip of FIG. 20.
Figure 23:
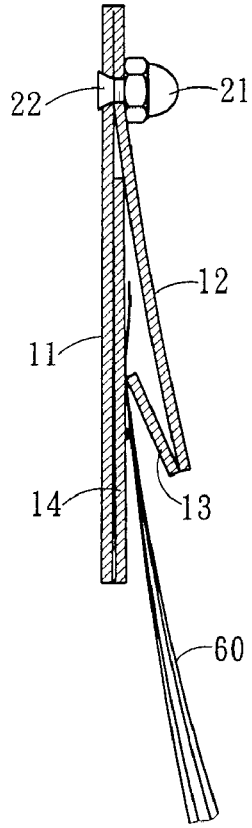
FIG. 23 is a whole view of the firmly secured paper clip of FIG. 20.

The expanding view of the sixth embodiment of the present invention is illustrated in FIG. 20. It is shown that the paper clip 1 is expanded and has a length longer than the prior art ones. The difference of this one from the previous one is that two ends of the third paper plate 13 and fourth paper plate 14 have notches 131 and 141. The corners of the first paper plate 11 and second paper plate 12 are formed with matched small holes 113, 122. Moreover, an elastic strip 80 encloses by the paper plate. When the paper clip 1 is fixed by a plurality of retainers 20 (for example, a nut 21 and a screw 22), a long paper clip is formed. The assembled process is illustrated in FIGS. 21 and 22 and the cross sectional view is illustrated in FIG. 23.

Seven Embodiment

Figure 24:
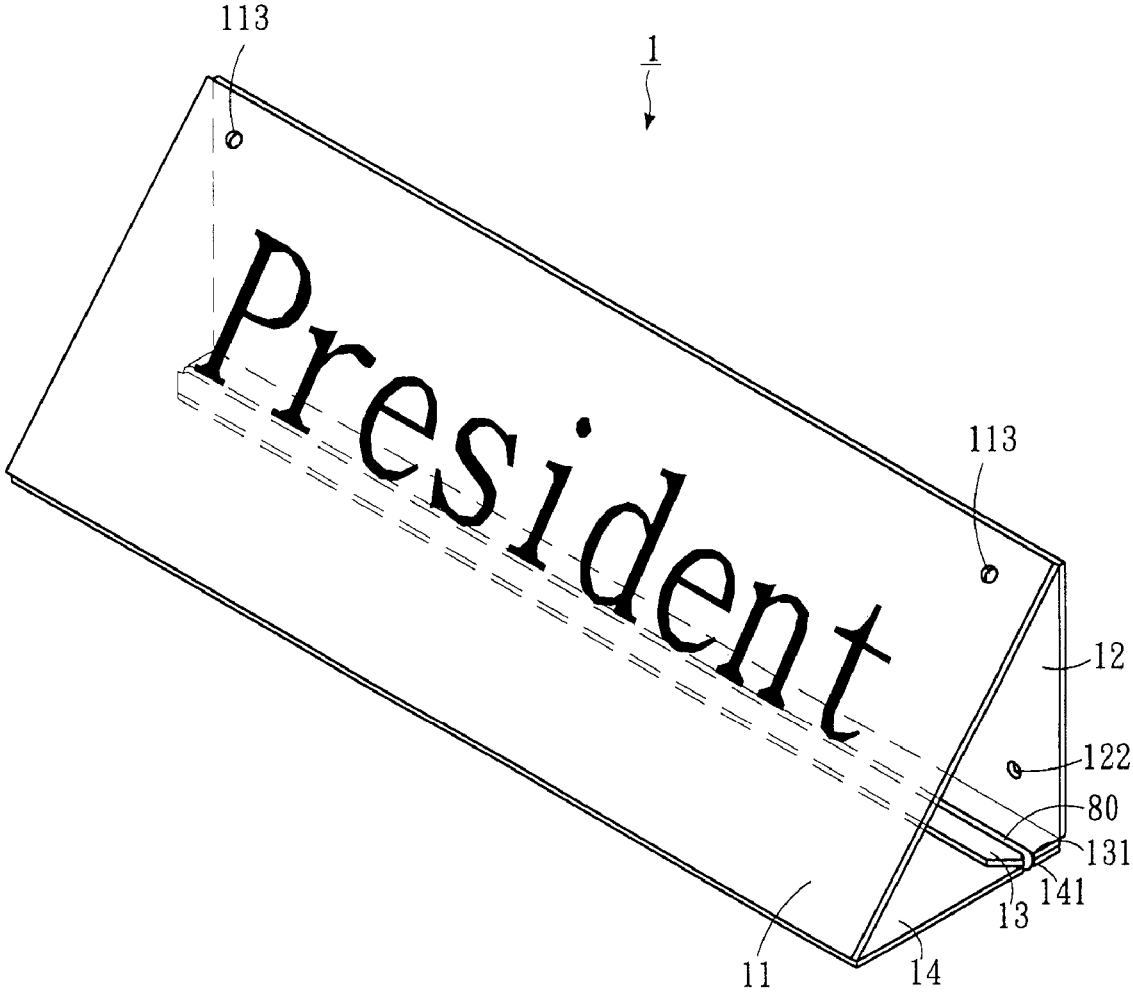
FIG. 24 shows one application of the firmly secured paper clip in the seven embodiment of the present invention.
Figure 25:
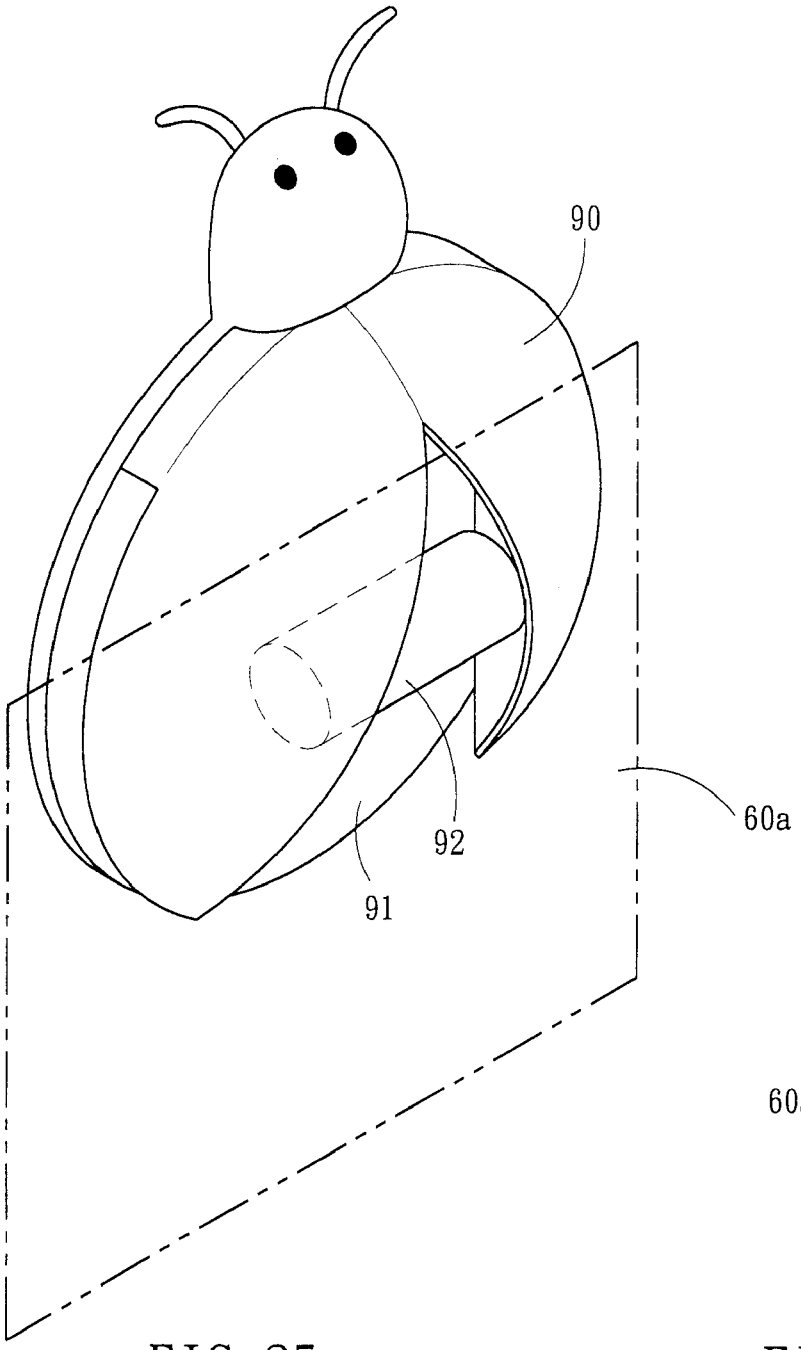
FIG. 25 is a perspective view of the firmly secured paper clip in the prior art.
Figure 26:
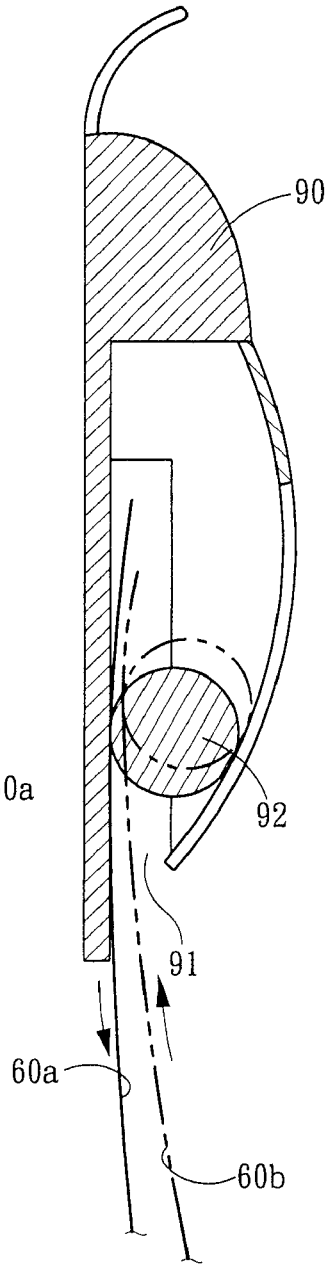
FIG. 26 shows the cross sectional view of a prior art paper clip.

Referring to FIG. 24, when above embodiment is not used as a paper clip, the retainer 20 can be removed, and then the third paper plate 13 and fourth paper plate 14 are engaged with an elastic strip 80 which are embedded into the notches 131, 141 at two sides of the paper plate. Thereby, the first paper plate 11, second paper plate 12 and fourth paper plate 14 of the paper clip become a triangular name card, indication card, etc. Thereby, the present invention has wide applications.

Effect of the Present Invention

1. The notepaper inserted is firmly secured therein and thus the later inserted notepaper can be inserted directly without needing to hold the former ones.
2. The paper clip can be suspended other than being stuck and adhered.
3. The user can assembled the paper clip by himself or herself Moreover, the present invention can be used for other uses, for example, as a name card, an indication card, etc.
4. If the present invention is not used, the paper clip can be detached so that the paper plates, retainer and adhesive element can be reused without inducing pollution problems.
5. The paper clip of the present invention is detached. Thus before exhibition, it is unnecessary to pack it. Thereby, the transfer and storage works can be performed easily.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A firmly secured paper clip comprising a foldable paper clip and a retainer, characterized in that:

the paper clip is capable of being folded as three paper plates, a first paper plate, a second paper plate, and a third paper plate; the first paper plate is the longest one, and the third paper plate is the shortest one; the first paper plate is connected to the second paper plate and the second paper plate is connected to the third paper plate;

in assembly, the first paper plate is used as a body, and the second paper plate is folded from the first paper plate and then is adhered on the first paper plate, and then the third paper plate is folded from the second paper plate and is located between the first paper plate and second paper plate;

the retainer serves to fix the first paper plate and second paper plate so as to form the whole paper clip; thereby, when a notepaper is inserted into a clamping opening between the first paper plate and third paper plate, it is firmly secured therein;

another end of the first paper plate is extended with a fourth paper plate which is located between the first paper plate and third paper plate; and the third paper plate is between the second paper plate and fourth paper plate and tightly presses the fourth paper plate.

2. The firmly secured paper clip as claimed in claim 1, wherein another end of the fourth paper plate is extended with a fifth paper plate having a length smaller than the fourth paper plate; in assembly, the fifth paper plate is located between the first paper plate and fourth paper plate, the fourth paper plate is located between the third paper plate and fifth paper plate and is formed with a clamping opening with the third paper plate; and the third paper plate is located between the second paper plate and the fourth paper plate and is formed with a clamping opening with the fourth paper plate.

3. The firmly secured paper clip as claimed in claim 1, the first paper plate and second paper plate have respective small holes at the folding line between the first paper plate and second paper plate; the two small holes are matched, and a screw and a nut are used to lock the first paper plate and second paper plate by passing through the small holes.

4. The firmly secured paper clip as claimed in claim 2, the first paper plate and second paper plate have respective small holes at the folding line between the first paper plate and second paper plate; the two small holes are matched, and a screw and a nut are used to lock the first paper plate and second paper plate by passing through the small holes.

5. The firmly secured paper clip as claimed in claim 1, wherein a back side of the first paper plate is installed with an adhesive element for adhering the paper clip upon an object.

6. The firmly secured paper clip as claimed in claim 2, wherein a back side of the first paper plate is installed with an adhesive element for adhering the paper clip upon an object.

7. The firmly secured paper clip as claimed in claim 1, wherein a back plate is fixed above the first paper plate by the retainer; an upper end of the back plate is a paper winding and a lower end of the back plate is extended with two paper plates; and the paper winding serves to fix a pen.

8. The firmly secured paper clip as claimed in claim 2, wherein a back plate is fixed above the first paper plate by the retainer; an upper end of the back plate is a paper winding and a lower end of the back plate is extended with two paper plates; and the paper winding serves to fix a pen.

9. The firmly secured paper clip as claimed in claim 1, wherein two paper plates are enclosed by an elastic strip so that the first paper plate, second paper plate and fourth paper plate are formed as a paper clip, a name plate or an indication plate.

10. The firmly secured paper clip as claimed in claim 2, wherein two paper plates are enclosed by an elastic strip so that the first paper plate, second paper plate and fourth paper plate are formed as a paper clip, a name plate or an indication plate.

11. The firmly secured paper clip as claimed in claim 9, wherein two sides of the paper plates are formed with notches for fixing the elastic strip.

12. The firmly secured paper clip as claimed in claim 10, wherein two sides of the paper plates are formed with notches for fixing the elastic strip.

* * * * *